US012767470B2

(12) United States Patent
Harris-Irvin

(10) Patent No.: US 12,767,470 B2
(45) Date of Patent: Oct. 20, 2026

(54) WONDERFUL WRAPS

(71) Applicant: Wanda Harris-Irvin, East Hazel Crest, IL (US)

(72) Inventor: Wanda Harris-Irvin, East Hazel Crest, IL (US)

( * ) Notice: Subject to any disclaimer, the term of this patent is extended or adjusted under 35 U.S.C. 154(b) by 0 days.

(21) Appl. No.: 18/641,638

(22) Filed: Apr. 22, 2024

(65) Prior Publication Data

US 2025/0326597 A1 Oct. 23, 2025

(51) Int. Cl.
*B65H 16/00* (2006.01)

(52) U.S. Cl.
CPC . *B65H 16/005* (2013.01); *B65H 2301/41342* (2013.01); *B65H 2402/443* (2013.01); *B65H 2701/1944* (2013.01)

(58) Field of Classification Search
None
See application file for complete search history.

(56) References Cited

U.S. PATENT DOCUMENTS 1,894,295 A * 1/1933 Scandore ..... B31B 50/00 138/104
3,132,784 A * 5/1964 Cohen ..... B65H 35/0006 225/37
3,263,883 A * 8/1966 Waltz ..... B65H 35/0026 225/36
3,672,550 A * 6/1972 Greco ..... B65H 35/0006 242/598.3
3,727,868 A * 4/1973 Buchanan ..... B65H 35/0026 248/205.3
4,417,495 A * 11/1983 Gordon ..... B26D 7/14 83/37
5,082,159 A * 1/1992 Gutierrez ..... B65H 35/002 225/34
5,139,210 A * 8/1992 Schaffer ..... B65H 49/28 242/129
5,301,854 A * 4/1994 Scobey ..... B65D 85/672 225/37
6,378,763 B1 * 4/2002 Nelson ..... B31C 3/00 229/162.5
9,491,932 B1 * 11/2016 Becattini, Jr. ..... E01H 1/1206
11,267,150 B1 * 3/2022 Smith ..... B65H 35/0086
2004/0004101 A1 * 1/2004 Bell ..... B26D 1/345 225/82

(Continued)

FOREIGN PATENT DOCUMENTS

GB 2528171 * 1/2016

*Primary Examiner* — William A. Rivera
(74) *Attorney, Agent, or Firm* — Ronald D. Baker, Esq.; BAKER & Co. LAW GROUP

(57) ABSTRACT

A wrapping paper dispensing device includes a container, a first internal roll, a second internal roll, and flaps. The container includes a rear wall, front wall, left-side wall, middle wall, right-side wall, top wall, and a bottom wall. The container is divided into a first section to dispense a wrapping paper and a second section to dispense adhesive tape. The first internal roll secures the wrapping paper. The second internal roll secures the adhesive tape. The first section includes a sliding cutter and the second section includes a serrated cutting blade. The sliding cutter is positioned along an edge of the front wall to severe the wrapping paper. The serrated cutting blade is positioned on the exterior surface of the front wall to sever the adhesive tape.

7 Claims, 8 Drawing Sheets

(56) References Cited

U.S. PATENT DOCUMENTS

| | | | | |
|---|---|---|---|---|
| 2004/0129123 | A1* | 7/2004 | Miller | B65H 35/002 30/317 |
| 2004/0144882 | A1* | 7/2004 | Small | B65H 35/0093 242/559 |
| 2006/0016153 | A1* | 1/2006 | King | B65B 41/12 53/390 |
| 2007/0193917 | A1* | 8/2007 | Munoz | B65H 35/0006 206/575 |
| 2009/0293695 | A1* | 12/2009 | Sacchetta | B65H 35/002 83/649 |
| 2013/0299545 | A1* | 11/2013 | Chang | B65H 35/002 225/89 |
| 2015/0107192 | A1* | 4/2015 | Loibl | B65H 35/0086 83/614 |
| 2015/0203313 | A1* | 7/2015 | Kaiser | B65H 35/002 242/562 |
| 2019/0352042 | A1* | 11/2019 | Slattery | B65D 5/3614 |
| 2022/0297970 | A1* | 9/2022 | Galvez | B65D 83/0882 |
| 2023/0057453 | A1* | 2/2023 | North | B65H 35/06 |
| 2023/0391580 | A1* | 12/2023 | Heiman | B65H 16/005 |

* cited by examiner

WONDERFUL WRAPS

FIELD OF INVENTION

The present invention is generally related to a wrapping paper dispensing device, and more particularly to a wrapping paper dispensing device that stores wrapping paper and adhesive tape and provides wrapping paper and adhesive tape without any wrinkles or deformations.

BACKGROUND OF INVENTION

The subject matter discussed in the background section should not be assumed to be prior art merely because of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Wrapping gifts and packages with wrapping paper and adhesive tape is a common practice for various occasions such as birthdays, holidays, and special events. Traditionally, people use separate rolls of wrapping paper and adhesive tape, which can be cumbersome to handle and often lead to disorganized wrapping stations. In addition, locating the end of the tape on the roll can be frustrating, resulting in wasted tape and time.

To address these issues, various dispensing devices have been introduced in the market. These devices attempt to streamline the process of dispensing wrapping paper and adhesive tape while keeping them organized and easily accessible. However, many existing devices are complicated in design and may not efficiently serve their purpose.

The present wrapping paper dispensing device overcomes the drawbacks of existing solutions and provides an improved and simplified device for dispensing wrapping paper and adhesive tape.

Thus, in view of the above, there is a long-felt need in the industry to address the aforementioned deficiencies and inadequacies.

Further limitations and disadvantages of conventional approaches will become apparent to one of skill in the art through the comparison of described systems with some aspects of the present disclosure, as outlined in the remainder of the present application and regarding the drawings. In some embodiment, the numbers expressing quantities or dimensions of items, and so forth, used to describe and claim certain embodiment of the invention are to be understood as being modified in some instances by the term "about."

SUMMARY OF THE INVENTION

A dispensing device to store wrapping paper and adhesive tape and provides wrapping paper and adhesive tape without any wrinkles or deformations are provided substantially, as shown in and/or described in connection with at least one of the figures.

An aspect of the present disclosure relates to a dispensing device that includes a container, a first internal roll, and a second internal roll. The container includes a rear wall, a front wall, a left-side wall, a middle wall, a right-side wall, a lid, and a bottom wall. The container is divided into a first section to dispense a wrapping paper and a second section to dispense adhesive tape. The first internal roll secures the wrapping paper. The first internal roll is attached to the left-side wall and the middle wall. The second internal roll secures the adhesive tape. The second internal roll is attached to the middle wall and the right-side wall. The first section includes a sliding cutter and the second section includes a serrated cutting blade. The sliding cutter is positioned along an edge of the front wall to sever the wrapping paper while the wrapping paper is supported on the first internal roll. The serrated cutting blade is positioned on the exterior surface of the front wall to sever the adhesive tape while the adhesive tape is supported on the second internal roll. In a non-limiting example, the apparatus could include flaps that are hinged to the rear wall of the container to secure a plurality of various lids of the container to the body of the container after securing the wrapping paper and the adhesive tape when inserted down inside the container.

In an aspect, the wrapping paper dispensing device includes a plurality of attachment feet positioned at a distal location of the bottom wall to provide stability when in use.

In an aspect, the wrapping paper dispensing device includes a cellophane window positioned on the top wall of the container to facilitate a user to identify a design of the wrapping paper secured on the first internal roll.

In an aspect, the lid of the container includes a handle to provide a convenient means of opening the container or carrying the container while a securing band is in place over the lid.

In an aspect, the handle is securely attached to the lid of the container on both sides.

In an aspect, the sliding cutter and the serrated cutting blade are made of stainless steel.

In an aspect, the sliding cutter severs the wrapping paper without one or more of a wrinkle or deformation.

In an aspect, the serrated cutting blade severs the adhesive tape without one or more of the wrinkle and deformation.

Accordingly, one advantage of the present invention is that it allows a neat, clean, and quick wrapping of gifts for special occasions and holidays.

Accordingly, one advantage of the present invention is that it enables an individual to remove the desired length of wrapping paper from the roll without using a screen.

Accordingly, one advantage of the present invention is that it produces clean, and straight cuts, unlike traditional scissors which can leave behind ragged or uneven edges on paper.

Accordingly, one advantage of the present invention is that it dispenses adhesive tape, and eliminates the need to keep a roll of adhesive tape nearby.

Accordingly, one advantage of the present invention is that it protects the wrapping paper from being crushed, ripped, or covered with dust while in storage.

Accordingly, one advantage of the present invention is that it reduces frustration and keeps the work area neat and organized.

Accordingly, one advantage of the present invention is that it saves time, money, and effort to store and provide wrapping paper and adhesive tape without any wrinkles or deformations.

These features and advantages of the present disclosure may be appreciated by reviewing the following description of the present disclosure, along with the accompanying figures wherein reference numerals refer to like parts.

BRIEF DESCRIPTION OF THE DRAWINGS

The accompanying drawings illustrate the embodiment of devices, systems, methods, and other aspects of the disclosure. Any person with ordinary skills in the art will appreciate that the illustrated element boundaries (e.g., boxes, groups of boxes, or other shapes) in the figures represent an example of the boundaries. In some examples, one element may be designed as multiple elements, or multiple elements may be designed as one element. In some examples, an element shown as an internal component of one element may be implemented as an external component in another and vice versa. Furthermore, the elements may not be drawn to scale.

Various embodiments will hereinafter be described in accordance with the appended drawings, which are provided to illustrate, not limit, the scope, wherein similar designations denote similar elements, and in which.

DETAILED DESCRIPTION OF THE EMBODIMENTS HEREIN

The present disclosure is best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented and the needs of a particular application may yield multiple alternative and suitable approaches to implement the functionality of any detail described herein. Therefore, any approach may extend beyond certain implementation choices in the following embodiments.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

Methods of the present invention may be implemented by performing or completing manually, automatically, or a combination thereof, selected steps or tasks. The term "method" refers to manners, means, techniques, and procedures for accomplishing a given task including, but not limited to, those manners, means, techniques, and procedures either known to or readily developed from known manners, means, techniques, and procedures by practitioners of the art to which the invention belongs. The descriptions, examples, methods, and materials presented in the claims and the specification are not to be construed as limiting but rather as illustrative only. Those skilled in the art will envision many other possible variations within the scope of the technology described herein.

Figure 1:
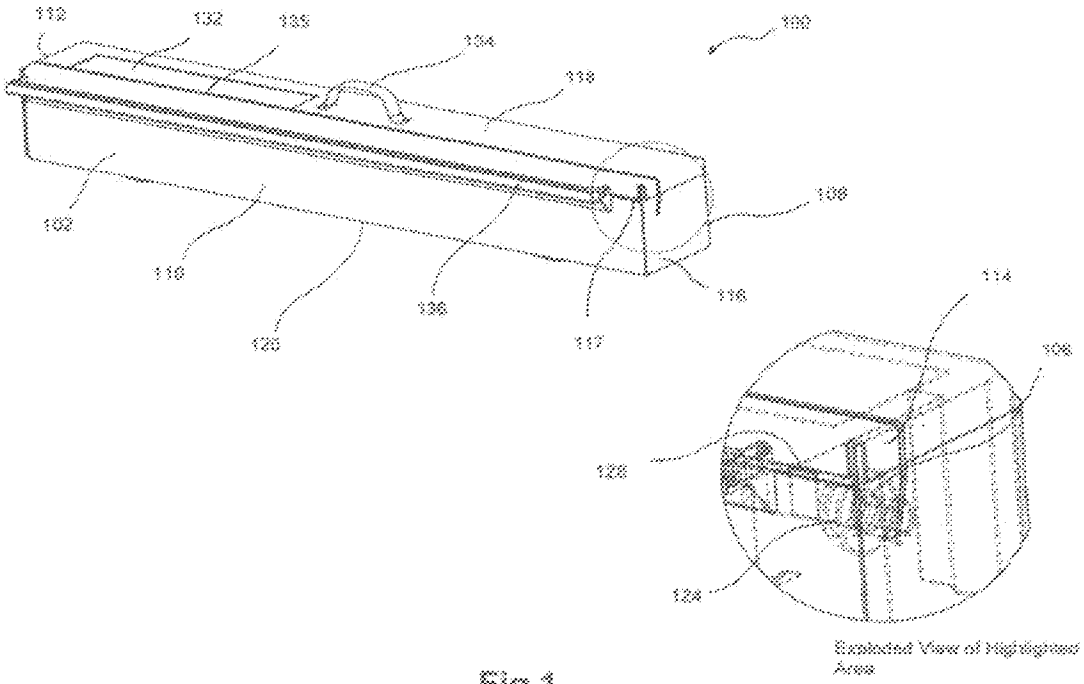
FIG. 1 illustrates a perspective view of a wrapping paper dispensing device, in accordance with at least one embodiment.

FIG. 1 illustrates a perspective view of a wrapping paper dispensing device 100 to include an exploded transparent view (1B) of internal parts, in accordance with at least one embodiment. The wrapping paper dispensing device 100 includes a container 102, a first internal roll 104 (not shown), and a second internal roll 106. The container 102 includes a rear wall 108, a front wall 110, a left-side wall 112, a middle wall 114, a right-side wall 116, a lid 118 that acts as a top wall, a cellophane window 132, a bottom wall 120, and a securing band 135 that is attached to the left-side 112 and right-side 116 walls in a manner to secure a lid 118. In a non-limiting embodiment, the container 102 is constructed primarily from cardboard. In an exemplary embodiment, the wrapping paper dispensing device 100, measuring approximately 42 inches long 4.5 inches wide, and 4.5 inches deep. The container includes a slit 117 along the front wall 110 for dispensing the wrapping paper. The embodiment also include a wrapping paper support apparatus 136 that is used to support the wrapping paper as it is prepared to be severed by a user. The wrapping paper support apparatus 136 is intended to act as a multi-use structure to allow the user to place the paper over a surface to hold in place prior to separating the portion of the wrapping paper that is intended to be used for wrapping. The image also shows a second internal roll 106 for installation of adhesive tape 124. The exploded view shows a serrated cutting blade 128 for cutting tape while in use. In an embodiment, the serrated cutting blade 128 severs the adhesive tape 124 without one or more of the wrinkle and deformation.

Figure 2:
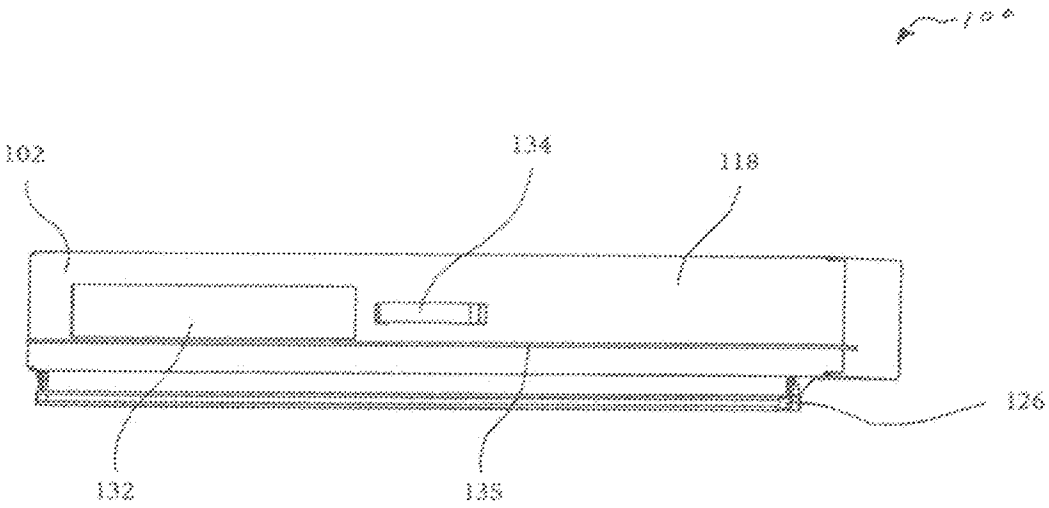
FIG. 2 illustrates a top view of the wrapping paper dispensing device, in accordance with at least one embodiment.

FIG. 2 illustrates a top-view of the wrapping paper dispensing device 100, in accordance with at least one embodiment. FIG. 1 is explained in conjunction with FIG. 1. The image shows the securing band 135 and cellophane window 132 positioned along the top surface of the lid 118 of the container 102 to allow a user to identify a design of the wrapping paper 122 secured on the first internal roll 104. In an embodiment, the lid 118 of the container 102 includes a handle 134 to provide a convenient means of carrying the container 102.

In an embodiment, the sliding cutter 126 and the serrated cutting blade 128 are made of stainless steel. In an embodiment, the sliding cutter 126 severs the wrapping paper 122 without one or more of a wrinkle and deformation.

Figure 3:
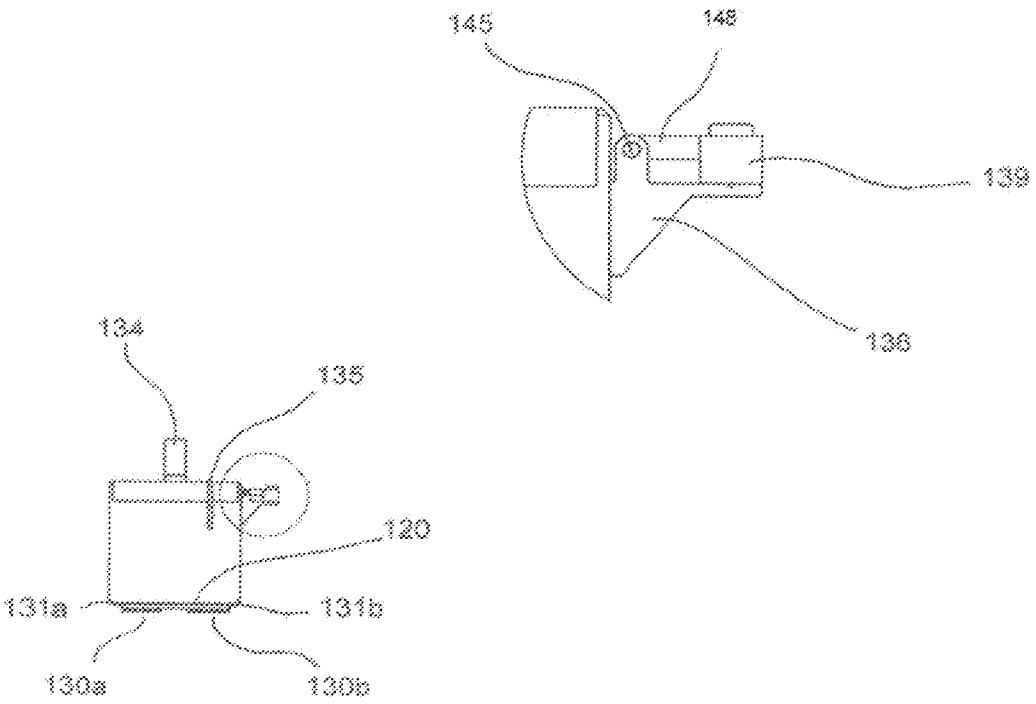
FIG. 3 illustrates a side-view of the wrapping paper dispensing device, in accordance with at least one embodiment.

FIG. 3 illustrates a side-view of the wrapping paper dispensing device 100, in accordance with at least one embodiment. The wrapping paper dispensing device 100 includes a handle 134, a securing band 135, at least four suction cups (130*a*, 130*b*, 130*c*, 130*d*) only 130*a* and 130*b* are shown attached to at least two attachment apparatus (131*a*, 131*b*) positioned at a distal location along the bottom wall 120 to provide stability when in use. The image also shows an exploded view of the wrapping paper support apparatus 136 that includes a rotation hinge 145 the rotatable securing apparatus 148 for holding the wrapping paper in place while in use. The embodiments shown are critical for a user to properly use the device 100 by extending the wrapping paper under the securing apparatus 139 to hold in place while the sliding cutter 126 (not shown) cuts the wrapping paper at a location preferred by the user.

Figure 4:
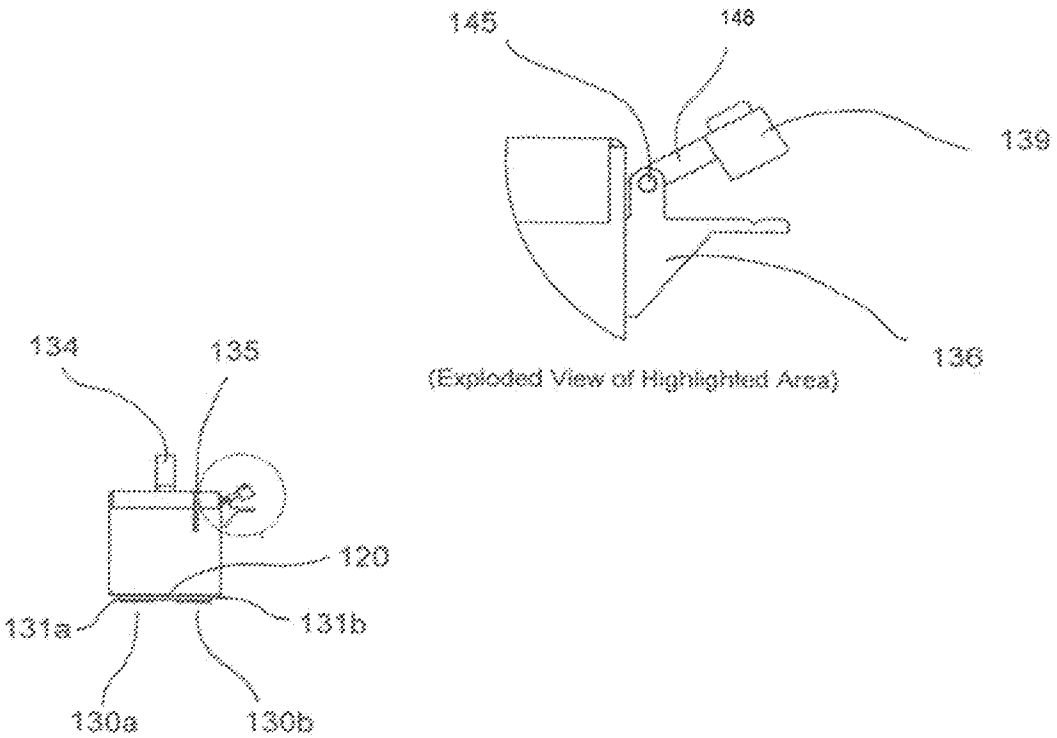
FIG. 4 illustrates a side-view of the wrapping paper dispensing device, in accordance with at least one embodiment.

FIG. 4 illustrates a side-view of the wrapping paper dispensing device 100, in accordance with at least one embodiment. FIG. 4 is explained in conjunction with FIG. 3. As also shown in FIG. 3, the image shows a side-view of the embodiment with the rotatable securing apparatus 148 in the upright position as operable by the rotation hinge 145 to receive the wrapping paper as described in FIG. 3. The drawing is ideal because it shows how the wrapping paper support apparatus 136 appears as it is prepared for receiving wrapping paper for cutting.

Figure 5:
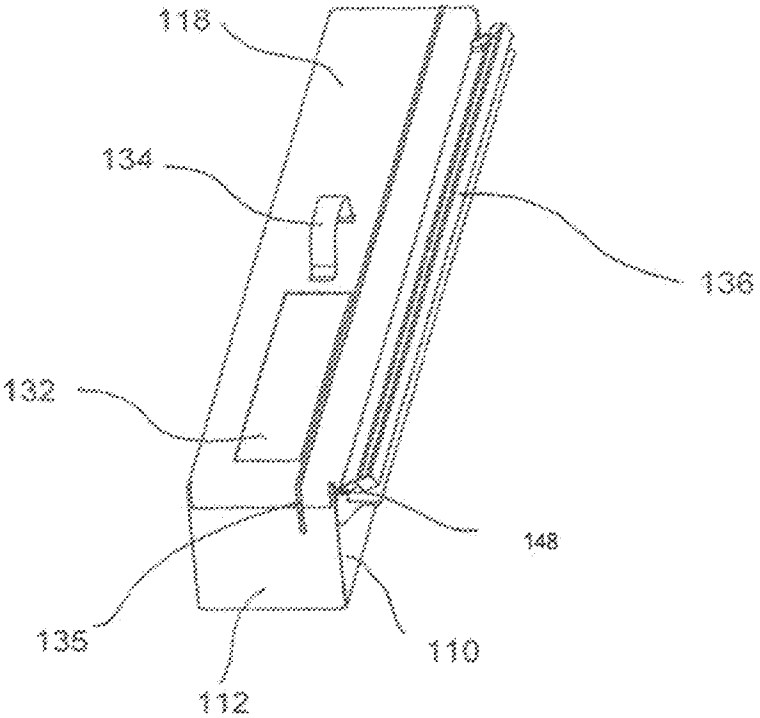
FIG. 5 illustrates an alternate perspective view of the wrapping paper dispensing device, in accordance with at least one embodiment.

FIG. 5 illustrates an alternate perspective view of the wrapping paper dispensing device, in accordance with at least one embodiment. The container 102 includes a handle 134, front wall 110, a left-side wall 112, a lid 118, a cellophane window 132, and a securing band 135 that is attached to both sides of the apparatus a manner to secure the lid 118. The drawing ideally shows the wrapping paper support apparatus 136 from a different angle with the rotatable securing apparatus 148 in a rotated position. The image also shows the handle 134 primarily used to either carry the apparatus or open the lid 118 depending on user preference.

Figure 6:
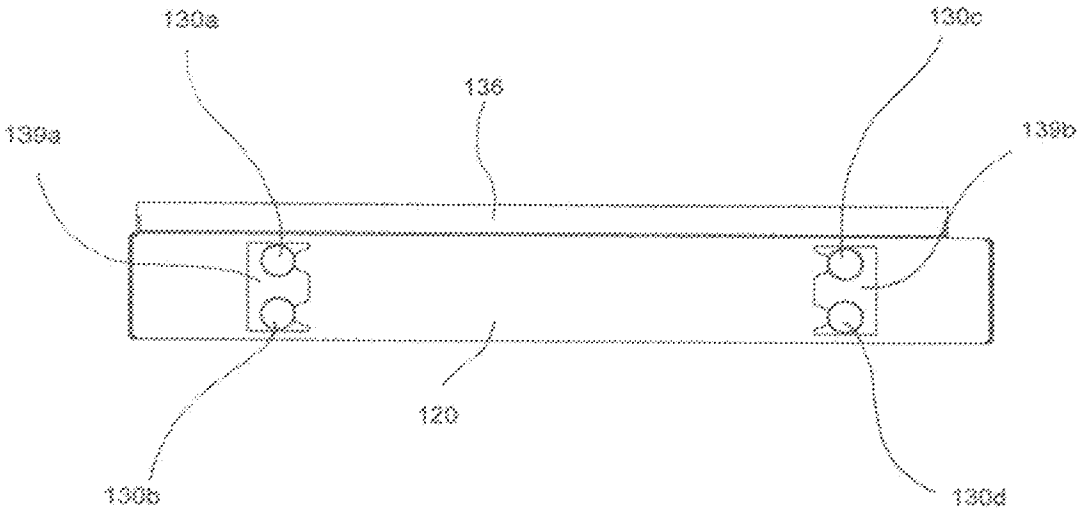
FIG. 6 illustrates a bottom-view of the wrapping paper dispensing device, in accordance with at least one embodiment.

FIG. 6 illustrates a bottom-view of the wrapping paper dispensing device, in accordance with at least one embodiment. FIG. 6 is explained in conjunction with FIG. 3. The wrapping paper dispensing device 100 as shown ideally includes at least four suction cups (130*a*, 130*b*, 130*c*, 130*d*) removably attached to at least two attachment apparatus (131*a*, 131*b*) positioned at a distal location along the bottom wall 120 to provide stability when in use. The suction cups can utilized to provide stability when the apparatus is in use by adhering to a matting surface. Furthermore, the suction cups (130*a*, 130*b*, 130*c*, 130*d*) can be removed from cleaning etc. The drawing also shows a bottom edge view of the wrapping paper support apparatus 136.

Figure 7:
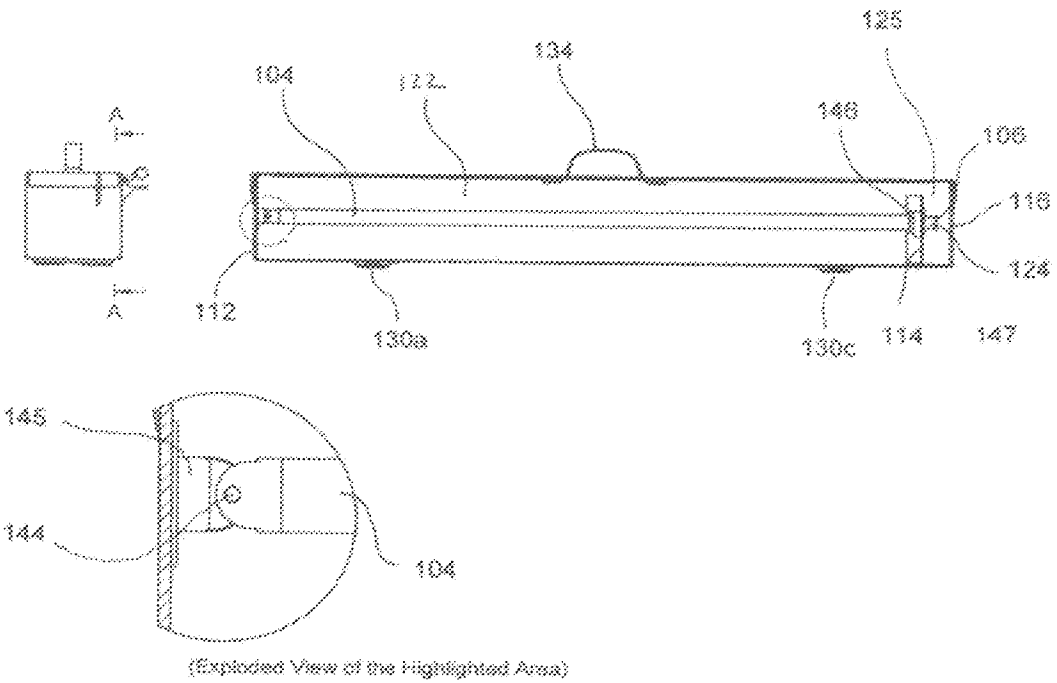
FIG. 7 illustrates an interior view of the wrapping paper dispensing device, in accordance with at least one embodiment.

FIG. 7 illustrates an interior view of the wrapping paper dispensing device, in accordance with at least one embodiment. The illustration shows a interior view of the apparatus to include the first and second internal rolls for receiving a spool of wrapping paper and tape during use. The illustration also shows an encircling band 146 for securing the spool of wrapping paper in place once applied to the first internal roll 104 to prevent unnecessary movement during use. The illustration also shows a collar 147 for supporting the first internal roll 104 once lowered into a horizontal position. The first internal roll 104 secures the wrapping paper. The first internal roll 104 is attached to the left-side wall 112 and the middle wall 114. In an embodiment, the first internal roll 104 is made of a plastic roll that has a length of 37 inches. The second internal roll 106 secures the adhesive tape 124. The second internal roll 106 is attached to the middle wall 114 and the right-side wall 116. In an embodiment, the second internal roll 106 is made of a plastic roll that has a length of 5 inches. The container 102 is divided into a first section 122 for wrapping paper and a second section 125 for tape.

The first section 122 includes a first sliding cutter and the second section 125 includes a serrated cutting blade. In an embodiment, the sliding cutter 126, and the serrated cutting blade 128 are positioned below adhesive tape and wrapping paper rolls on the exterior of the container for quick and accurate cutting. The sliding cutter 126 is positioned on an exterior surface of the front wall 110 to sever the wrapping paper 122 while the wrapping paper 122 is supported on the first internal roll 104. The serrated cutting blade 128 is positioned on the exterior surface of the front wall 110 to sever the adhesive tape 124 while the adhesive tape 124 is supported on the second internal roll 106. The exploded view shows one end of the first internal roll 104 coupled to an attached apparatus 145 along the left-side wall 112 to include a binge 144 that allows the distal end of the first internal roll 104 to be rotated upward.

Figure 8:
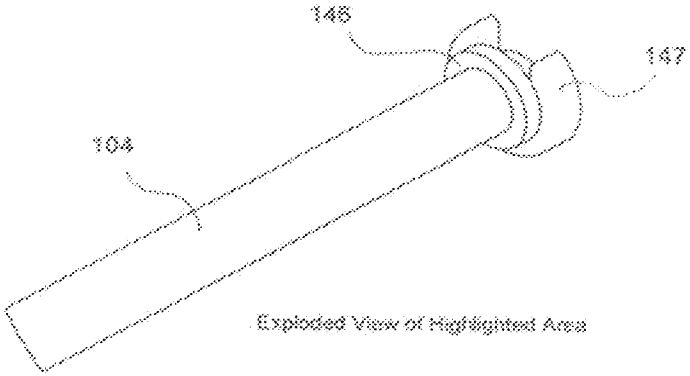
FIG. 8 illustrates an exploded view of the first internal roll for the wrapping paper dispensing device, in accordance with at least one embodiment.
Figure 8:
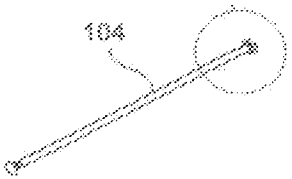

FIG. 8 illustrates an exploded view of the first internal roll 104 for the wrapping paper dispensing device 100, in accordance with at least one embodiment. The exploded view shows a end of the first internal roll 104 coupled to a collar 147 while in use. The encircling band 146 is shown positioned adjacent to the collar 147.

In an embodiment, the wrapping paper dispensing device may be purchased empty for use as a dispenser or may include wrapping paper and the adhesive tape. Accordingly, in one embodiment of the present invention, the first internal roll and the second internal roll are rotatably attached to the left-side wall, middle wall, and right-side wall, respectively. Accordingly, one embodiment of the present invention, the first internal roll, and the second internal roll are equipped with braking mechanisms to control the unwinding of the wrapping paper and the adhesive tape, respectively. Accordingly, one embodiment of the present invention, the wrapping paper dispensing device further comprises a compartment on the bottom wall to store additional small accessories related to wrapping and taping.

As used herein, and unless the context dictates otherwise, the term "configured to" or "coupled to" is intended to include both direct coupling (in which two elements that are coupled to each other contact each other) and indirect coupling (in which at least one additional element is located between the two elements). Therefore, the terms "configured to", "configured with", "coupled to" and "coupled with" are used synonymously. Within the context of this document terms "configured to", "coupled to" and "coupled with" are also used euphemistically to mean "communicatively coupled with" over a network, where two or more devices can exchange data with each other over the network, possibly via one or more intermediary device.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, utilized, or combined with other elements, components, or steps that are not expressly referenced.

Thus, the present wrapping paper dispensing device offers a practical and user-friendly approach to managing both items in a single container, thereby creating a more efficient and organized wrapping process. By dividing the container into two sections, one for wrapping paper and the other for adhesive tape, the device ensures each material remains easily accessible. The inclusion of internal rolls for both wrapping paper and adhesive tape, along with a sliding cutter for wrapping paper and a serrated cutting blade for adhesive tape, simplifies the cutting process and minimizes the chances of tape wastage. The positioning of the cutting elements on the front wall allows for precise cutting while the materials are supported on their respective internal rolls. Furthermore, the addition of flaps hinged to the rear wall of the container provides a secure closure after the wrapping paper and adhesive tape have been used, preventing them from becoming tangled or misplaced. This feature ensures that the device maintains its organized and tidy arrangement for future use.

Overall, the wrapping paper dispensing device offers an innovative and efficient solution to the problems encountered during the gift-wrapping process. It simplifies the dispensing and cutting of wrapping paper and adhesive tape, saves time, reduces wastage, and promotes a clutter-free wrapping station.

No language in the specification should be construed as indicating any non-claimed element as essential to the practice of the invention.

It will be apparent to those skilled in the art that various modifications and variations can be made to the present invention without departing from the scope of the invention. There is no intention to limit the invention to the specific form or forms enclosed. On the contrary, the intention is to cover all modifications, alternative constructions, and equivalents falling within the scope of the invention, as defined in the appended claims. Thus, it is intended that the present invention cover the modifications and variations of this invention, provided they are within the scope of the appended claims and their equivalents.

What is claimed is:

1. A wrapping paper dispensing device, comprising:

a container comprises a rear wall, a front wall, a left-side wall, a middle wall, a right-side wall, a lid, and a bottom wall, at least four attachment feet along the bottom wall, wherein the container is divided into a first section to dispense a wrapping paper, and a second section to dispense an adhesive tape, wherein the front wall includes a horizontal slot for dispersing the wrapping paper;

a first internal roll to secure the wrapping paper;

a second internal roll to secure the adhesive tape, wherein the first section comprises a sliding cutter and the second section comprises a serrated cutting blade, wherein the sliding cutter is positioned along an edge of the front wall to sever the wrapping paper while the wrapping paper is supported on the first internal roll, wherein the serrated cutting blade is positioned on the exterior surface of the front wall to sever the adhesive tape while the adhesive tape is supported on the second internal roll; wherein the bottom wall includes at least two attachment devices coupled to said at least four attachment feet; and a wrapping paper support apparatus, wherein the wrapping paper support apparatus has a rotating member to secure the wrapping paper while in use, wherein the second internal roll is attached to the middle wall, and the right-side wall, the second internal roll further includes an encircling band that slides along the length of the first internal roll.

2. The wrapping paper dispensing device as claimed in claim 1, comprises at least two attachment feet positioned at a distal location of the bottom wall to provide stability when in use; wherein the attachment feet can be removeably attached to the bottom wall.

3. The wrapping paper dispensing device as claimed in claim 1, comprises a cellophane window positioned on the lid of the container to facilitate a user to identify a design of the wrapping paper secured on the first internal roll.

4. The wrapping paper dispensing device as claimed in claim 1, wherein the first internal roll is attached to the left-side wall and the middle wall.

5. The wrapping paper dispensing device as claimed in claim 1, wherein the lid of the container comprises a handle to provide a convenient means of carrying the container.

6. The wrapping paper dispensing device as claimed in claim 1, wherein the sliding cutter severs the wrapping paper without one or more of a wrinkle, and a deformation.

7. The wrapping paper dispensing device as claimed in claim 1, wherein the serrated cutting blade severs the adhesive tape without one or more of the wrinkle and the deformation; the serrated cutting blade is designed to cut across the adhesive tape for cutting purposes.

* * * * *